US005957274A

United States Patent [19]

Ovadia

[11] Patent Number: 5,957,274

[45] Date of Patent: Sep. 28, 1999

[54] JEWELRY PAD WITH FLEXIBLE, RESILIENT OPPOSING Z-LOCK FINGERS, AND A SLOT WHICH IS OPEN BEHIND AND BELOW THE FINGERS FOR RECEIVING A TAG

[76] Inventor: Joseph Ovadia, 109 Long Hill Rd., Little Falls, N.J. 07424

[21] Appl. No.: 09/197,190

[22] Filed: Nov. 20, 1998

[51] Int. Cl.[6] ..... A45C 11/04

[52] U.S. Cl. ..... 206/6.1; 206/566; 206/493

[58] Field of Search ..... 206/756, 6.1, 493, 206/495, 566, 486, 487, 459.5

[56] References Cited

U.S. PATENT DOCUMENTS

| | | | |
|---|---|---|---|
| 5,511,653 | 4/1996 | Ovadia | 206/6.1 |
| 5,758,765 | 6/1998 | Ovadia . | |
| 5,775,484 | 7/1998 | Ovadia | 206/6.1 |

*Primary Examiner*—Jacob K. Ackun
*Attorney, Agent, or Firm*—Richard M. Goldberg

[57] ABSTRACT

A jewelry pad for holding jewelry items, includes an upper wall having an upper exposed surface; at least one supporting wall connected to the upper wall for supporting the upper wall on a surface; two L-shaped opposing fingers being formed on the upper exposed surface and having facing ends which together form a Z-lock configuration to hold a jewelry item on the upper surface, the fingers being made of a resilient, flexible material, each L-shaped finger having a horizontal leg and a vertical leg for securing the horizontal leg in spaced relation above the upper surface; an elongated slot extending below the horizontal legs and continuing outwardly past the horizontal legs toward side edges of the upper surface, for receiving a tag therein; anchoring bars secured to the vertical legs and extending toward ends of the elongated slot, the anchoring bars also being secured to the upper surface at a front edge of the elongated slot, and the vertical legs and anchoring bars being cut-away toward a rear thereof so that lower rear edges thereof are provided in spaced relation from the upper surface to permit a tag to be received in the elongated slot from a rear edge of the elongated slot; and the jewelry pad including the fingers, the anchoring bars and the elongated slot being molded as an integral, one-piece construction.

12 Claims, 3 Drawing Sheets

JEWELRY PAD WITH FLEXIBLE, RESILIENT OPPOSING Z-LOCK FINGERS, AND A SLOT WHICH IS OPEN BEHIND AND BELOW THE FINGERS FOR RECEIVING A TAG

BACKGROUND OF THE INVENTION

The present invention relates generally to jewelry pads, and more particularly, is directed to a jewelry pad with flexible, resilient fingers having ends with a Z-lock configuration, and a slot which is open immediately behind and below the fingers for holding a price tag.

Jewelry pads which are adapted to fit within recesses of a jewelry tray and held therein, are well known.

Conventionally, jewelry pads of this type for displaying jewelry items such as pendants, earrings and the like include a substantially rectangular upper inclined wall that extends upwardly and rearwardly from the upper edge of a short front wall at an inclination to the ground surface. Side walls of a substantially triangular configuration have their upper inclined edges connected with respective side edges of the upper inclined wall. A substantially rectangular rear wall has its upper edge connected with the rear edge of the upper inclined wall and its opposite side edges connected to the rear edges of the triangular side walls. The rear wall may be inclined rearwardly and downwardly. With this arrangement, the lower edges of the front wall, side walls and rear wall lie in the same horizontal plane and support the pad on a flat surface.

In accordance with prior inventions of the same applicant herein, each pad is preferably made from a flexible and resilient plastic material that can be deformed but which retains its shape when the deformation force is removed. Thus, the pad is preferably made of a high memory material with a substantially thin, constant thickness throughout. As a result, the pad has a hollow area defined between the underside of the inclined upper wall and the front wall, side walls and rear wall.

According to a prior invention by the same applicant herein, as described for example, in U.S. Pat. No. 5,758,765, issued Jun. 2, 1998, and the entire disclosure of which is incorporated herein by reference, two opposing L-shaped fingers are formed on the upper exposed surface of the inclined upper wall for holding jewelry items such as the bails of pendants thereon.

However, a problem with such arrangement is that there is generally no place to provide a tag containing the price or other information about the jewelry item. Thus, the tag is generally secured directly to the jewelry item, detracting from the appearance of the jewelry item. Alternatively, the tag is placed on the upper surface of the pad below the jewelry item. However, this is often obscured by the jewelry item itself.

OBJECTS AND SUMMARY OF THE INVENTION

Accordingly, it is an object of the present invention to provide a jewelry pad that overcomes the problems with the aforementioned prior art.

It is another object of the present invention to provide a jewelry pad with flexible, resilient fingers having ends with a Z-lock configuration, and a slot which is open immediately behind and below the fingers for holding a price tag.

It is still another object of the present invention to provide a jewelry pad in which the slot is open immediately behind and below the Z-lock so that a tag therein does not obscure the jewelry item, but rather, is positioned immediately adjacent to the jewelry item.

It is yet another object of the present invention to provide a jewelry pad in which the jewelry pad, Z-lock and slot are molded as an integral, one-piece construction.

It is a yet further object of the present invention to provide a jewelry pad which is inexpensive to manufacture.

In accordance with an aspect of the present invention, a jewelry pad for holding jewelry items, includes an upper wall having an upper exposed surface; two L-shaped opposing fingers formed on the upper exposed surface and facing each other to hold a jewelry item on the upper surface, the fingers being made of a resilient, flexible material, each L-shaped finger having a horizontal leg in spaced relation above the upper surface and a vertical leg for securing the horizontal leg in the spaced relation; an elongated slot extending below the horizontal legs and continuing outwardly past the horizontal legs toward side edges of the upper surface, for receiving a tag therein; and the vertical leg of each finger being secured to the upper surface only at a front edge of the elongated slot so that lower rear edges of the vertical legs are provided in spaced relation from the upper surface to permit the tag to be received in the elongated slot from a rear edge of the elongated slot.

Preferably, at least one supporting wall is connected to the upper wall for supporting the upper wall on a surface. The at least one supporting wall includes substantially parallel side walls connected to side edges of the upper wall, and a rear wall connected to a rear edge of the upper wall.

Anchoring bars are secured to the vertical legs and extend toward ends of the elongated slot, the anchoring bars also being secured to the upper surface at a front edge of the elongated slot and being cut-away toward a rear of the anchoring bars so that lower rear edges of the anchoring bars are provided in spaced relation from the upper surface to permit the tag to be received in the elongated slot from a rear edge of the elongated slot. The anchoring bars also include ends secured to the upper surface at opposite ends of the elongated slot.

Preferably, the fingers having facing ends which together form a Z-lock configuration.

Also, the jewelry pad including the fingers, the anchoring bars and the elongated slot is molded as an integral, one-piece construction.

In accordance with another aspect of the present invention, a jewelry pad for holding jewelry items, includes an upper wall having an upper exposed surface; two L-shaped opposing fingers formed on the upper exposed surface and facing each other to hold a jewelry item on the upper surface, the fingers being made of a resilient, flexible material, each L-shaped finger having a horizontal leg in spaced relation above the upper surface and a vertical leg for securing the horizontal leg in the spaced relation; an elongated slot extending below the horizontal legs and continuing outwardly past the horizontal legs toward side edges of the upper surface, for receiving a tag therein; the vertical leg of each finger being secured to the upper surface only at a front edge of the elongated slot so that lower rear edges of the vertical legs are provided in spaced relation from the upper surface to permit the tag to be received in the elongated slot from a rear edge of the elongated slot; anchoring bars secured to the vertical legs and extending toward ends of the elongated slot, the anchoring bars also being secured to the upper surface at a front edge of the elongated slot and being cut-away toward a rear of the anchoring bars so that lower rear edges of the anchoring bars are provided in spaced relation from the upper surface to permit the tag to be received in the elongated slot from a rear edge of the elongated slot; and the jewelry pad including the fingers, the anchoring bars and the elongated slot is molded as an integral, onepiece construction.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
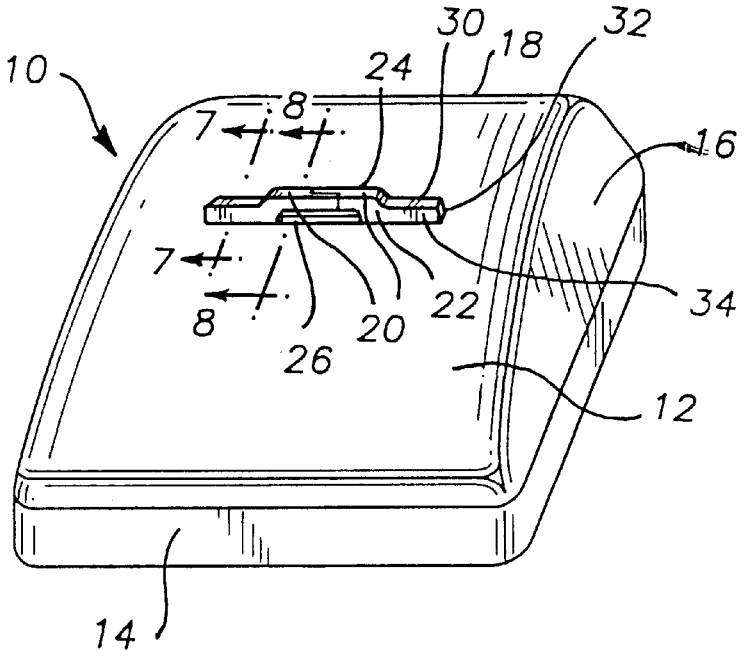
FIG. 1 is a perspective view of a jewelry pad according to the present invention.
Figure 2:
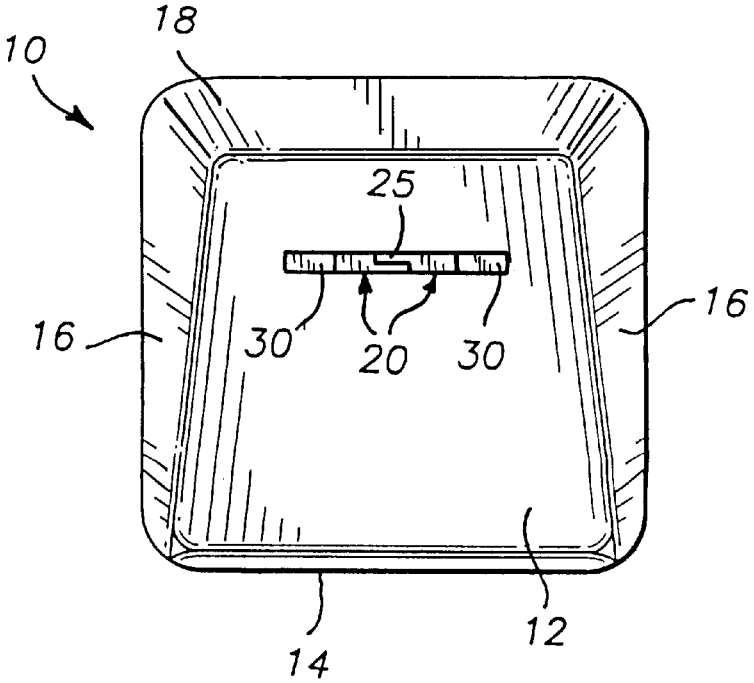
FIG. 2 is a top plan view of the jewelry pad of FIG. 1.
Figure 3:
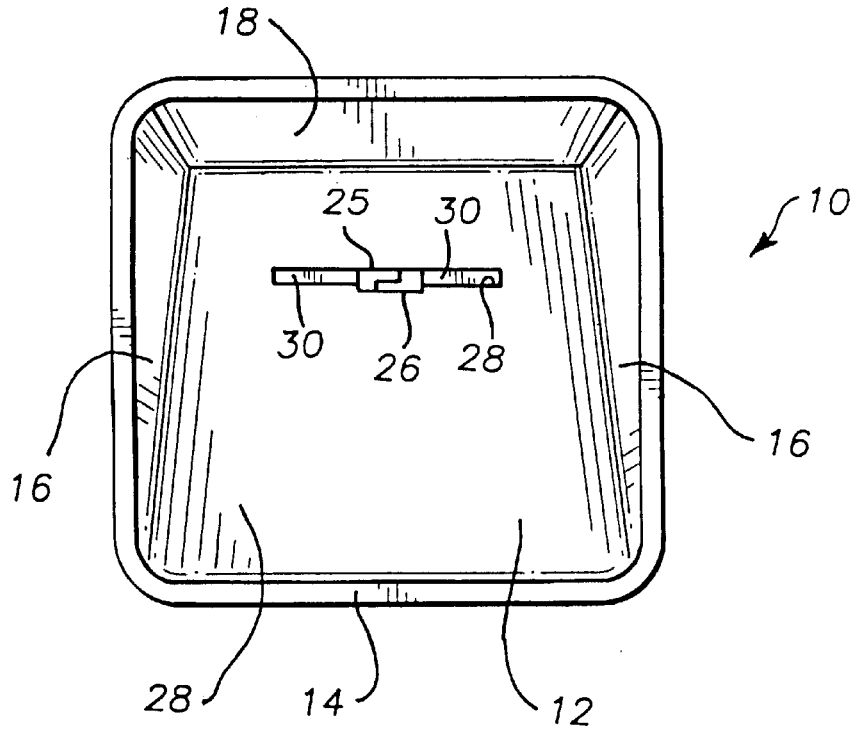
FIG. 3 is a bottom plan view of the jewelry pad of FIG. 1.
Figure 4:
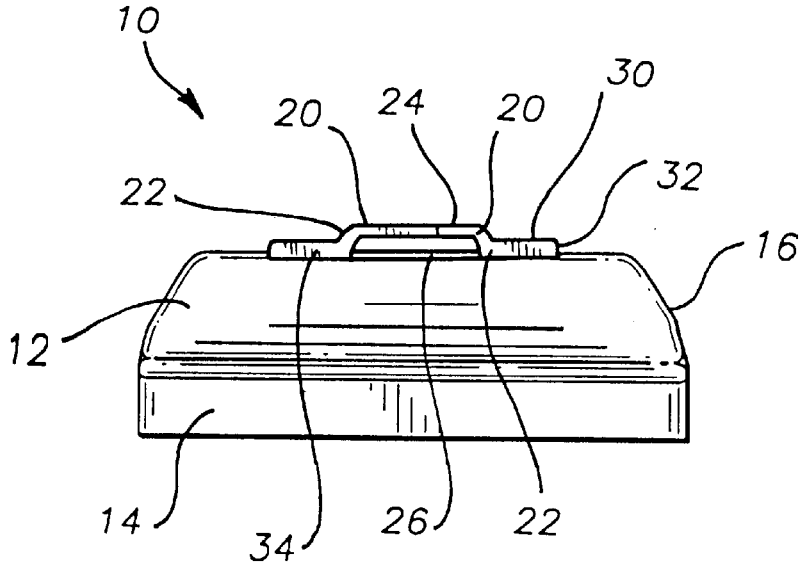
FIG. 4 is a front elevational view of the jewelry pad of FIG. 1.
Figure 5:
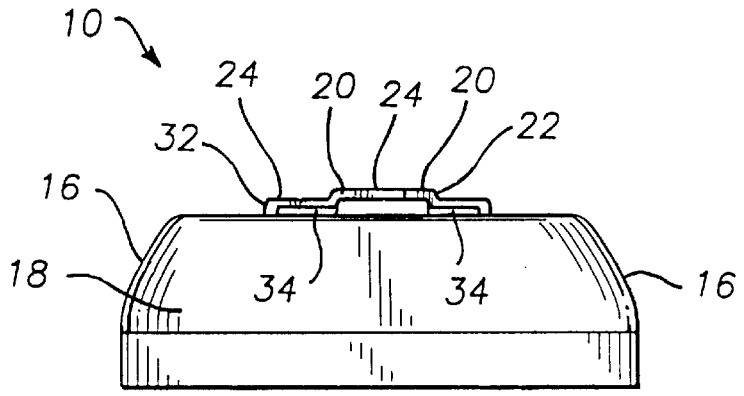
FIG. 5 is a rear elevational view of the jewelry pad of FIG. 1.
Figure 6:
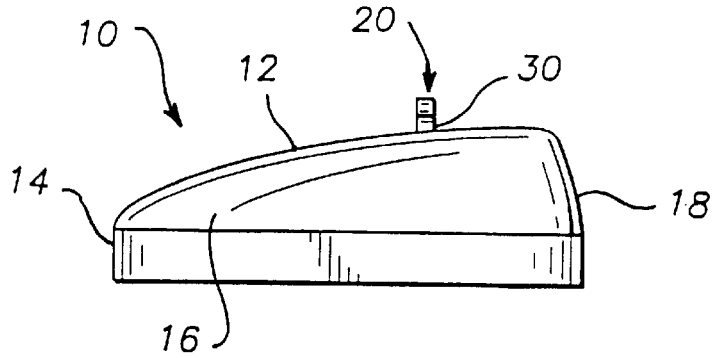
FIG. 6 is a right side elevational view of the jewelry pad of FIG. 1.

Referring to the drawings in detail, a deformable and resilient jewelry pad 10 according to the present invention includes a substantially rectangular upper inclined wall 12 that extends upwardly and rearwardly from the upper edge of a short front wall 14 at an inclination of about 20° to the ground surface. Inclined wall 12 can have a slightly convex bowed configuration from its front edge to its rear edge. Side walls 16 of a substantially triangular configuration have their upper inclined edges connected with respective side edges of upper inclined wall 12. A substantially rectangular rear wall 18 has its upper edge connected with the rear edge of upper inclined wall 12 and its opposite side edges connected to the rear edges of triangular side walls 16. Rear wall 18 may be inclined rearwardly and downwardly at an inclination of, for example, about 15°. With this arrangement, the lower edges of front wall 14, side walls 16 and rear wall 18 lie in the same horizontal plane and support pad 10 on a flat surface. A hollow open area 28 is defined between the underside of upper wall 12 and front wall 14, side wall 16 and rear wall 18.

Pad 10 is adapted to fit within one of many recesses of a jewelry tray (not shown), as is well-known, for example, as shown in U.S. Pat. No. 4,432,456.

Preferably, each pad 10 is made from a flexible and resilient plastic material that can be deformed but which retains its shape when the deformation force is removed. Alternatively, pad 10 can be made of a rubber or any other suitable material. In any event, pad 10 is made of a high memory material with a substantially thin, constant thickness throughout. Because pad 10 has a substantially constant thickness throughout, it is thin and therefore easily deformable, while reducing the amount of material that is used.

Thus, each pad 10 is formed as a single, unitary plastic molded part, although it is also possible to provide a fabric material or flocked layer thereon.

Specifically, unlike conventional jewelry pads, each pad 10 is formed in an injection molding operation, using pellets of an injection molding material, such as polypropylene, olefinic materials, polyurethane and other synthetic rubber, plastic rubber or flexible materials. An example of such a material is one sold under the trademark "KRATON". Thus, the pellets are placed in a conduit leading to a space between two molded halves. The pellets are heated to liquefy the same, and the liquid is forced under pressure to a space between the two closed mold halves to form the jewelry pad. Then, the mold is cooled, and the mold halves are separated, in order to remove the formed jewelry pad therefrom. Injection molded rubbery pads 10 are flexible and do not lose memory.

In addition, two L-shaped fingers 20 extend from the upper surface of upper wall 12 in facing and touching, or substantially touching, relation to each other. Specifically, each L-shaped finger 20 includes a vertically extending leg 22 and a horizontally extending leg 24 extending from the upper end of vertically extending leg 22 in spaced relation above the upper surface of upper wall 12, with the free ends of horizontally extending legs 24 being in contact with or close to each other. Fingers 20 are made of the same material as jewelry pad 10 and are formed in the same molding operation so as to be integral therewith. Thus, fingers 20 are entirely flexible so that they can be bent in order to receive a bail of a jewelry pendant or other jewelry item therein. When released, fingers 20 return to their initial positions in order to releasably secure the jewelry item thereto so that the jewelry item rests on the upper exposed surface of upper wall 12. This aspect of the jewelry pad 10 of the present invention is described and claimed in my earlier co-pending U.S. patent application Ser. No. 08/465,142, filed Jun. 5, 1995, the entire disclosure of which is incorporated herein by reference. In such case, it will be appreciated that any of the variations in said aforementioned U.S. patent application Ser. No. 08/465,142, are also incorporated herein by reference and can likewise be used with jewelry pad 10 according to the present invention.

Preferably, as shown, L-shaped fingers 20 have free ends with a complementary curvature that contact and mate with each other in an overlapping manner, or are at least closely positioned adjacent each other, but which can be separated from each other. Still more preferably, the complementary curvature at the ends of L-shaped fingers 20, when fingers 20 are closed as shown, forms a Z- or inverted Z- configuration, and thereby is denoted as a Z-lock 25. With the above arrangement, the bail of a pendant can readily be held by fingers 20 with the pendant resting on the upper exposed surface of upper wall 12.

As a result of the formation of fingers 20, an elongated through opening 26 is provided through upper wall 12. Conventionally, this through opening 26 is equivalent in size in the widthwise direction of jewelry pad 10 to the length of legs 24. Such width, however, is too small to receive a tag.

In accordance with an important aspect of the present invention, slot 26 is extended by slot extensions 28 on opposite sides thereof to extend to a substantial width of upper inclined wall 12 of jewelry pad 10, while maintaining the relatively small size of fingers 20 in order to preserve the strength thereof for holding a jewelry item. In such case, however, there must be a way to anchor L-shaped fingers 20 to upper inclined surface 12.

Accordingly, elongated anchoring bars 30 are integrally formed at opposite sides of each finger 20 and extend from each finger 20 toward the respective side wall 16 of jewelry pad 10. The entire jewelry pad 10, including fingers 20, extension bars 30, slot 26 and slot extensions 28 is molded as an integral, one-piece construction.

Each anchoring bar 30 has an outer end 32 secured to upper inclined wall 12 at the end of each slot extension 28, and a front wall 34 secured to a front edge of each slot extension 28. However, each anchoring bar 30 is cut-away at an underside thereof, at 36, from front wall 34 and extending rearwardly. Thus, the lower rear edge 38 of each anchoring bar 30 is not attached to upper inclined wall 12, but rather, is positioned in spaced relation thereabove. The same is true as to the lower edges of vertically extending walls 22 which are secured only to a front edge of each slot 26 and are cut-away so that the lower rear edge thereof is not attached to upper inclined wall 12, but rather, is also positioned in spaced relation thereof.

Figure 7:
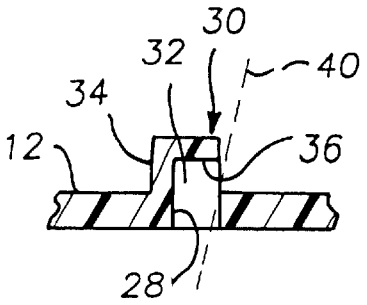
FIG. 7 is a cross-sectional view of the jewelry pad of FIG. 1, along taken along line 7—7 thereof.
Figure 8:
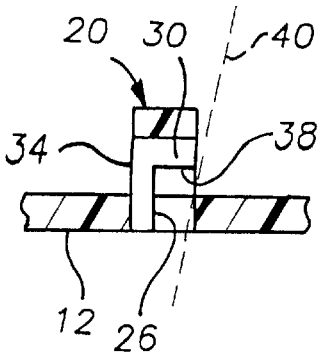
FIG. 8 is a cross-sectional view of the jewelry pad of FIG. 1, along taken along line 8—8 thereof.

This means that slot 26 and contiguous slot extensions 28 are open and accessible from the rear of jewelry pad 10, from a position immediately behind fingers 20 and anchoring bars 30 for a substantial width of upper inclined surface 12, that is, for the entire length of slot 26 and slot extensions 28, which together in the claims is referred to as an elongated slot. This permits a tag 40, shown schematically in dashed lines in FIGS. 7 and 8, to be placed therein. Further, tag 40 is provided at an incline in order to be received in slot 26 and slot extensions 28, and is thereby held frictionally between the rear upper edges of slot extensions 28 and the lower rear edges of anchoring bars 30, which are positioned in spaced relation above upper inclined surface 12.

The formation of anchoring bars 30, which are secured to upper inclined surface 12 only at ends 32 and front walls 34 thereof, provides that fingers 20 are securely anchored at lower ends of vertically extending leg 22 thereof, while still providing an elongated slot which is equivalent to the total length of slot 26 and slot extensions 28, for receiving a tag therein.

Thus, jewelry pad 10 is provided with Z-lock fingers 20 and the elongated slot for receiving a tag, with the slot being open immediately behind and below Z-lock fingers 20 and anchoring bars 30, so as not to obscure the jewelry item, while allowing a tag to be positioned immediately adjacent to the jewelry item. Further, the entire jewelry pad 10, including fingers 20, anchoring bars 30, slot 26 and slot extensions 28 is molded as an integral, one-piece construction, thereby greatly reducing the cost thereof.

As a first alternative embodiment, front wall 14, side walls 16 and rear wall 18 can be eliminated so that only upper inclined wall 12 is formed to rest in a recess of a jewelry tray.

As a second alternative embodiment, anchoring bars 30 could be eliminated, with only a thin front wall portion of each vertically extending leg 22 secured to a front edge of each slot 26, and with slot extensions 28 extending outwardly from and contiguous with slot 26.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A jewelry pad for holding jewelry items, comprising:

an upper wall having an upper exposed surface;

two L-shaped opposing fingers formed on said upper exposed surface and facing each other to hold a jewelry item on the upper surface, said fingers being made of a resilient, flexible material, each L-shaped finger having a horizontal leg in spaced relation above said upper surface and a vertical leg for securing said horizontal leg in said spaced relation;

an elongated slot extending below said horizontal legs and continuing outwardly past said horizontal legs toward side edges of said upper surface, for receiving a tag therein; and said vertical leg of each said finger being secured to said upper surface only at a front edge of said elongated slot so that lower rear edges of said vertical legs are provided in spaced relation from said upper surface to permit the tag to be received in said elongated slot from a rear edge of said elongated slot.

2. A jewelry pad according to claim 1, further comprising at least one supporting wall connected to the upper wall for supporting the upper wall on a surface.

3. A jewelry pad according to claim 2, wherein said at least one supporting wall includes substantially parallel side walls connected to side edges of said upper wall, and a rear wall connected to a rear edge of said upper wall.

4. A jewelry pad according to claim 1, further comprising anchoring bars secured to said vertical legs and extending toward ends of said elongated slot, said anchoring bars also being secured to said upper surface at a front edge of said elongated slot and being cut-away toward a rear of said anchoring bars so that lower rear edges of said anchoring bars are provided in spaced relation from said upper surface to permit the tag to be received in said elongated slot from a rear edge of said elongated slot.

5. A jewelry pad according to claim 4, wherein said anchoring bars also include ends secured to said upper surface at opposite ends of said elongated slot.

6. A jewelry pad according to claim 1, wherein said fingers having facing ends which together form a Z-lock configuration.

7. A jewelry pad according to claim 1, wherein said jewelry pad including said fingers, said anchoring bars and said elongated slot is molded as an integral, one-piece construction.

8. A jewelry pad for holding jewelry items, comprising:

an upper wall having an upper exposed surface;

two L-shaped opposing fingers formed on said upper exposed surface and facing each other to hold a jewelry item on the upper surface, said fingers being made of a resilient, flexible material, each L-shaped finger having a horizontal leg in spaced relation above said upper surface and a vertical leg for securing said horizontal leg in said spaced relation;

an elongated slot extending below said horizontal legs and continuing outwardly past said horizontal legs toward side edges of said upper surface, for receiving a tag therein;

said vertical leg of each said finger being secured to said upper surface only at a front edge of said elongated slot so that lower rear edges of said vertical legs are provided in spaced relation from said upper surface to permit the tag to be received in said elongated slot from a rear edge of said elongated slot;

anchoring bars secured to said vertical legs and extending toward ends of said elongated slot, said anchoring bars also being secured to said upper surface at a front edge of said elongated slot and being cut-away toward a rear of said anchoring bars so that lower rear edges of said anchoring bars are provided in spaced relation from said upper surface to permit the tag to be received in said elongated slot from a rear edge of said elongated slot; and said jewelry pad including said fingers, said anchoring bars and said elongated slot is molded as an integral, one-piece construction.

9. A jewelry pad according to claim 8, further comprising at least one supporting wall connected to the upper wall for supporting the upper wall on a surface.

10. A jewelry pad according to claim 9, wherein said at least one supporting wall includes substantially parallel side walls connected to side edges of said upper wall, and a rear wall connected to a rear edge of said upper wall.

11. A jewelry pad according to claim 8, wherein said anchoring bars also include ends secured to said upper surface at opposite ends of said elongated slot.

12. A jewelry pad according to claim 8, wherein said fingers having facing ends which together form a Z-lock configuration.

* * * * *